United States Patent [19]

Gazapo Santa-Olalla et al.

[11] Patent Number: 4,632,735

[45] Date of Patent: Dec. 30, 1986

[54] PROCESS FOR THE ELECTROLYTIC COLORING OF ALUMINUM OR ALUMINUM ALLOYS

[75] Inventors: José L. Gazapo Santa-Olalla; Juan Gonzalez Feliu, both of Alicante, Spain

[73] Assignee: Empresa Nacional del Aluminio, S.A., Madrid, Spain

[21] Appl. No.: 697,111

[22] Filed: Jan. 31, 1985

Related U.S. Application Data

[63] Continuation-in-part of Ser. No. 149,310, May 13, 1980, abandoned.

[30] Foreign Application Priority Data

Jul. 4, 1979 [ES] Spain ..... 482.210

[51] Int. Cl.[4] ..... C25D 11/22

[52] U.S. Cl. ..... 204/37.6; 204/42

[58] Field of Search ..... 204/37.6, 38.3, 56 R, 204/42

[56] References Cited

U.S. PATENT DOCUMENTS

| | | | |
|---|---|---|---|
| 3,704,209 | 11/1972 | Patrie | 204/35 N |
| 3,788,956 | 1/1974 | Patrie | 204/35 N |
| 3,892,636 | 7/1975 | Kaneda et al. | 204/37.6 |
| 3,915,813 | 10/1975 | Abe | 204/35 N |
| 4,021,315 | 5/1977 | Yanagida et al. | 204/35 N |
| 4,251,330 | 2/1981 | Sheasby et al. | 204/37.6 |

*Primary Examiner*—John F. Niebling
*Assistant Examiner*—William T. Leader
*Attorney, Agent, or Firm*—Wenderoth, Lind & Ponack

[57] ABSTRACT

A process for the electrolytic coloring of aluminum or aluminum alloys consisting of subjecting the previously anodized piece to two electrolytic treatments in a coloring solution (solution of soluble metal salts). The first consists of an alternating current treatment with an elevated positive polarization, to cause a modification in the pores of the anodic layer. After this electrolytic treatment and in the same bath, the sample is colored by applying thereto an alternating current. The electrolytic treatment prior to coloring permits colors differing from those produced in conventional coloring to be obtained.

4 Claims, No Drawings

PROCESS FOR THE ELECTROLYTIC COLORING OF ALUMINUM OR ALUMINUM ALLOYS

CROSS-REFERENCE TO RELATED APPLICATION

This application is a continuation-in-part of Ser. No. 149,310 filed May 13, 1980, now abandoned.

INTRODUCTION

Currently the colouring of anodized aluminium is well known and it is possible to use different processes, although the conventional processes are colouring by dyeing, integral colouring and electrolytic colouring.

Colouring by dyeing presents the advantage that the complete range of colours and shades can be obtained, however the resistance to light of this type of finish is poor, wherefore its application to articles for use outdoors is very limited.

Integral colouring permits substantially lightresistant finishes to be produced, however the range of colours to be produced is limited to bronzes, blacks and greys, and also, due to the high energy cost of this technique, the application of these processes is becoming rather reduced.

Electrolytic colouring permits different colours to be obtained, such as bronzes, blacks and reds with a good resistance to light and a lower energy cost; however it is necessary to have a colouring bath for each colour and therefore the majority of the installations only produce bronzes and blacks.

This invention relates to an electrolytic colouring process which permits a wide range of colours and shades to be obtained using a single colouring bath.

DESCRIPTION OF THE PRIOR ART

The search for new colours using the electrolytic colouring technique has been a widely developed field due to the current limitations. In 1968 French Pat. No. 1,605,100 described a method by means of which it was possible to obtain yellow and brick-red colours by the partial anodic dissolution of the particles deposited on the pores in a sodium thiosulphate solution.

Thereafter German Pat. Nos. 2,106,388 and 2,106,389 recited a process for producing bluish colours which mainly consists in electrodepositing, on a chromic acid formed anodic layer, metals such as Cu, Co and Ni, and simultaneously sealing under special conditions; this patent has the disadvantage that colouring can only take place on samples previously anodized in chromic acid and not sulphuric acid which is currently the most widely used anodizing process and, furthermore, the use of a special sealing is another limitation of this process.

From 1974 onwards various patents appeared, inter alia, Spanish Pat. No. 437,604 (equivalent to U.S. Pat. No. 4,011,152) and French Pat. No. 2,236,029 whereby the use of high sulphuric acid concentrations in the colouring bath produced colours differing from those normally obtained in electrolytic colouring baths.

These processes present the typical disadvantages of working with high proton concentrations, that is, the possibility of producing spalling of the oxide layer at not very high voltages, difficulty of impossibility of producing very dark tones or blacks, and the production of very soft anodic layers due to the dissolution effect of the anodic layer by the acid during the colouring process, and finally the possibility of producing colour losses in the washing processes, subsequent to colouring, and in the sealing processes due to the acid hauled.

Thereafter, U.S. Pat. Nos. 4,022,671; 4,066,816 and 4,152,222 use a double anodizing process, firstly in sulphuric and phosphoric acid solutions and a posterior colouring in a solution of metal salts. These patents claim to produce a wide variety of colours in a single bath but present the disadvantage of a reanodizing in a phosphoric acid bath, between the conventional anodizing in sulphuric acid and the colouring.

In accordance with these patents, the colours are produced by optical interference and the fundamental requirement is to have a pore size equal to or more than 260 Å.

Other patents, such as U.S. Pat. No. 4,021,315, claim a process having two electrolytic treatments with direct current in the colouring bath to prevent spalling and to obtain finishes having better characteristics. However, neither the modification of the anodic layer nor the wide range of colours sought by this process can be obtained, due among other aspects, to the different values of the parameters involved in the process.

Finally, U.S. Pat. Nos. 3,788,956, 3,704,209 and 3,915,813 refer to different wave forms to increase the quality of the product and the uniformity of the colour in the colouring process.

DETAILED DESCRIPTION OF THE INVENTION

The present invention refers to a process for producing anodic layers electrolytically coloured in soluble metal salt baths, mainly characterized by producing colours differing from those normally obtained in these baths. It is known that with copper salt electrolytes it is possible to obtain reds and blacks; however, blues, greens, greys, violets, etc. can be obtained with the process of the present invention. Likewise, with tin salts it is only possible to produce, with the conventional processes, bronzes and blacks; however, blues, greens, yellows, reds, etc. can be obtained with the process of the present invention.

The process for electrolytically colouring anodized aluminium of the present invention mainly consists of the following.

First, an anodic layer is produced through a conventional anodizing process in sulphuric acid having a concentration ranging from 150 to 200 g/l at a current density of from 1 to 2 A/dm$^2$ corresponding to a potential of from 12 to 20 volts of direct current for treatment times of from 15 minutes to 1 hour.

Once the anodic layer, whose thickness can range from 3 to 30 microns, has been produced by this process, the aluminium piece is introduced in the colouring bath. The colouring bath consists of a solution of metal salts having a pH above 0.8. Among the metal salts to be used in this process are metal sulphates, acetates and chlorides, such as copper, tin, cobalt and nickel.

Once the aluminium piece has been submerged in the colouring bath, it is subjected to two electrolytic processes, both with alternating current.

In the first electrolytic process, the aluminium sample is subjected to an alternating current in which the effective voltage applied is from 7 to 35 volts and the peak voltage of the negative semi-wave is always less than that of the positive semi-wave and is from 2 to 15 peak volts.

The term alternating current will be applied here to any type of variable current between the positive and negative polarity, having a positive and a negative cycle alternately, and can be purely wavy, modified or any other wave form.

The objective of this treatment is to produce an anodic layer close to the aluminium/anodic layer interphase with pores having dimensions differing from those obtained in conventional anodizing with direct current.

We have observed that this modification is particularly effective when a small cathodic peak potential ranging from 2 to 15 peak volts is used.

Another characteristic of the process is that the ratio between the anodic and cathodic potential must be such that during the modification process the metal is not deposited, since even a minimum deposition (appearance of colour) inhibits the modification of the bottom of the pores.

The time used in this reanodizing process can vary from 3 to 30 minutes if interference colours or colours differing from normal are to be obtained in the second electrolytic process, although preferably times of from 5 to 10 minutes will be used. If bronze tones of higher uniformity than obtained by conventional methods are to be obtained in the second electrolytic process, this reanodizing process is conducted for from 15 seconds to 2.75 minutes.

Once the first described electrolytic process has terminated, the aluminium piece is subjected in the same bath to an alternating current, in which the cathodic peak voltage is equal or similar to the anodic peak voltage, to produce the electrodeposition of the metal pigment (colouring of the anodic layer).

The term alternating current used in the preceding paragraph refers to any type of wave variable between the positive and negative polarities, having a positive and a negative cycle alternately.

The voltages used in this treatment can vary from 7 to 25 volts and the treatment time from 2 to 30 minutes.

It has been observed that both in the first as well as in the second steps, better results are obtained when programs are used instead of a constant voltage throughout the entire process.

The pH of the solution plays an important role and in all cases it must be maintained above 0.8. The temperature of the colouring bath is not critical in the range of room temperature (15° to 25° C.).

EXAMPLE 1

After the workpiece has been treated with a neutral type degreasing agent, it is subjected to etching in a 6% caustic soda solution at 60° C. for 5 minutes. It is then washed with water and neutralized in 1/1 v/v of nitric acid, whereafter it is introduced in a bath containing a 15% by weight solution of sulphuric acid. On this piece is applied a direct current having a voltage of 17 volts and a current density of 1.5 A/dm$^2$ for 30 minutes to form a transparent oxide layer of 12–14 microns.

The piece thus treated is submerged in a bath having the following composition

| | |
|---|---|
| $SO_4Cu.5H_2O$ | 30 g/l |
| Tartaric acid | 30 g/l |
| | pH - 1.5 |

The pH is adjusted by adding sulphuric acid. The piece is firstly subjected to an alternating current at having an anodic peak voltage of 25 volts and a cathodic peak voltage of 5 volts for 7 minutes. After this period of time an alternating current at having a voltage value of 15 volts is applied. The colours obtained were the following:

| Time (minutes) | Colour |
|---|---|
| 1 | Violet-grey |
| 2 | Neutral grey |
| 3 | Blue-grey |
| 4 | Violet |
| 5 | Brown |

The thickness of the modified layer and the diameters of the pores in the normal and modified anodized zone were measured by electronic microscopy.

| | Modified Layer | | | Normal Layer | |
|---|---|---|---|---|---|
| Colour | Thickness Å | Ø Pore Å | Ø Cell Å | Ø Pore Å | Ø Cell Å |
| Blue-grey | 3000 | 180 | 480 | 125 | 400 |

EXAMPLE 2

A sample treated in the same manner as in example 1, was subjected after anodizing and in the colouring bath to a continuous anodic voltage of 25 volts for 7 minutes and then to a colouring step with an alternating current identical to that of the preceding example. The resulting colour was as follows:

| Time (minutes) | Colour |
|---|---|
| 1 | Pink |
| 2 | Light Red |
| 3 | Average Red |
| 4 | Average Red |
| 5 | Dark Red |

As can be observed, a range of colours as that obtained in example 1 is not obtained using the conditions of this example 2.

This is due to the use of direct current in the first phase of this colouring step.

Finally, it must be pointed out that the carrying out of the colouring method described can take place, under optimum conditions, using the colouring equipment described in U.S. Pat. No. 4011152 (granted on Mar. 8, 1977).

We claim:

1. A process for the electrolytic colouring of an aluminum or aluminum alloy substrate, which process comprises the following steps:

(a) subjecting the substrate to an anodic oxidizing process in a sulphuric acid solution to produce an anodic layer having a thickness of from 3 to 30 microns;

(b) subjecting the anodized substrate to an alternating current, in a metal salt solution having a pH of greater than 0.8, applying different anodic and cathodic peak voltages to modify the anodic layer, with the proviso that the substrate is not coloured during this step, a voltage being applied which has an effective value of from 7 to 35 volts, the cathodic peak voltage being from 2 to 15 volts and always being less than the anodic peak voltage, this step being conducted for a period of time from 15 seconds to 30 minutes; and (c) subjecting the substrate modified in accordance with step (b) to an alternating current, in a metal salt solution having a pH of greater than 0.8, at an applied voltage of from 7 to 25 volts for a period of time from 2 to 30 minutes, to colour the substrate.

2. A process according to claim 1, wherein step (b) is conducted for a period of time of from 15 seconds to 2.75 minutes, and step (c) is conducted to obtain bronze tones on the substrate.

3. A process according to claim 1, wherein steps (b) and (c) are conducted in the same metal salt solution.

4. The process according to claim 3, wherein the metal salt is selected from the group consisting of tin, copper, cobalt and nickel salts.

* * * * *